United States Patent [19]

Pfizenmaier

[11] Patent Number: 4,799,660

[45] Date of Patent: Jan. 24, 1989

[54] DEVICE FOR FEEDING A PAPER WEB TO A CROSS CUTTER

[75] Inventor: Wolfgang Pfizenmaier, Neckargemünd, Fed. Rep. of Germany

[73] Assignee: Heidelberger Druckmaschinen AG, Heidelberg, Fed. Rep. of Germany

[21] Appl. No.: 170,037

[22] Filed: Mar. 21, 1988

Related U.S. Application Data

[63] Continuation of Ser. No. 85,273, Aug. 10, 1987, abandoned, which is a continuation of Ser. No. 803,538, Dec. 2, 1985, abandoned.

[30] Foreign Application Priority Data

Dec. 4, 1984 [DE] Fed. Rep. of Germany ..... 3444150

[51] Int. Cl.[4] ..... B42F 13/56

[52] U.S. Cl. ..... 270/21.1; 101/226; 493/362

[58] Field of Search ..... 270/21.1, 20.1; 101/224, 256, 226, 227; 493/352, 353, 356, 357, 361, 362

[56] References Cited

U.S. PATENT DOCUMENTS 1,749,546 3/1930 Reynolds ..... 270/21.1
2,613,077 10/1952 Smith, Jr. ..... 270/5

FOREIGN PATENT DOCUMENTS 2513244 8/1977 Fed. Rep. of Germany ..... 270/5
1492118 11/1977 United Kingdom ..... 270/5

*Primary Examiner*—Eugene H. Eickholt
*Attorney, Agent, or Firm*—Herbert L. Lerner; Laurence A. Greenberg

[57] ABSTRACT

A device for feeding a paper web to a cross cutter which is located downstream from a rotary printing machine in a travel direction of a paper web and which delivers cut sections of the paper web in flat disposition includes draw rollers and a former disposed downstream from the rotary printing machine for respectively tensioning and folding the paper web in longitudinal direction thereof, additional draw rollers and register rollers located downstream from the first-mentioned draw rollers and the former in the travel direction of the paper web for feeding the longitudinally folded paper web to a cross cutter, and a folding apparatus disposed adjacent to the cross cutter downstream from the rotary printing machine in the travel direction of the paper web, the cross cutter and the folding apparatus being formed as separate units.

1 Claim, 1 Drawing Sheet

DEVICE FOR FEEDING A PAPER WEB TO A CROSS CUTTER

Figure 2:
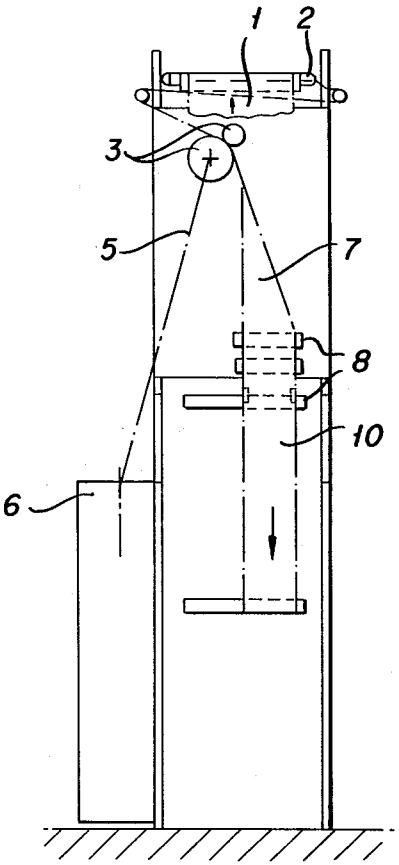

This application is a continuation of application Ser. No. 085,273, filed Aug. 10, 1987, now abandoned which in turn is a continuation of application Ser. No. 803,538, filed Dec. 2, 1985 and now abandoned.

The invention relates to a device for feeding a paper web to a cross cutter and, more particularly, to such a cross cutter which is located downstream from a rotary printing machine in a travel direction of a paper web and which delivers cut sections of the paper web in flat disposition.

Conventional cross cutters of this general type permit a paper web which has been printed in a rotary printing machine to be divided into individual, unfolded sheets and to deposit and stack these sheets flatly in a so-called in-flat or broadsheet delivery unit. In practice, it also happens that the cross cutter is associated additionally with a conventional folding apparatus of the printing machine so that the printer has a possibility of producing usual or normal folded printed products in addition to the web sections which are delivered flat i.e. non-folded. Because of spatial requirements or limitations in printing shops or plants, it is of extreme importance that these additional units or pieces of equipment be able to be attached even in confined spaces and that the printing machine be able to operate at maximum productive capacity irrespective of which unit is being used.

It is accordingly an object of the invention to provide a device for feeding a paper web to a cross cutter for a rotary printing machine which forms a smear and crease-free longitudinal fold in the paper web without requiring additional space and great expense.

With the foregoing and other objects in view, there is provided, in accordance with the invention, a device for feeding a paper web to a cross cutter which is located downstream from a rotary printing machine in a travel direction of a paper web and which delivers cut sections of the paper web in flat disposition, comprising draw rollers and a former disposed downstream from the rotary printing machine for respectively tensioning and folding the paper web in longitudinal direction thereof, additional draw rollers and register rollers located downstream from the first-mentioned draw rollers and the former in the travel direction of the paper web for feeding the longitudinally folded paper web to a cross cutter, and a folding apparatus disposed adjacent to the cross cutter downstream from the rotary printing machine in the travel direction of the paper web, the cross cutter and the folding apparatus being formed as separate units. A device has thus been produced which, without any special technical expense, achieves smear and crease-free folding of any type of paper without producing any waste due to the folding process and which provides an economical solution even for confined space conditions.

Other features which are considered as characteristic for the invention are set forth in the appended claims.

Although the invention is illustrated and described herein as embodied in a device for feeding a paper web to a cross cutter, it is nevertheless not intended to be limited to the details shown, since various modifications and structural changes may be made therein without departing from the spirit of the invention and within the scope and range of equivalents of the claims.

Figure 1:
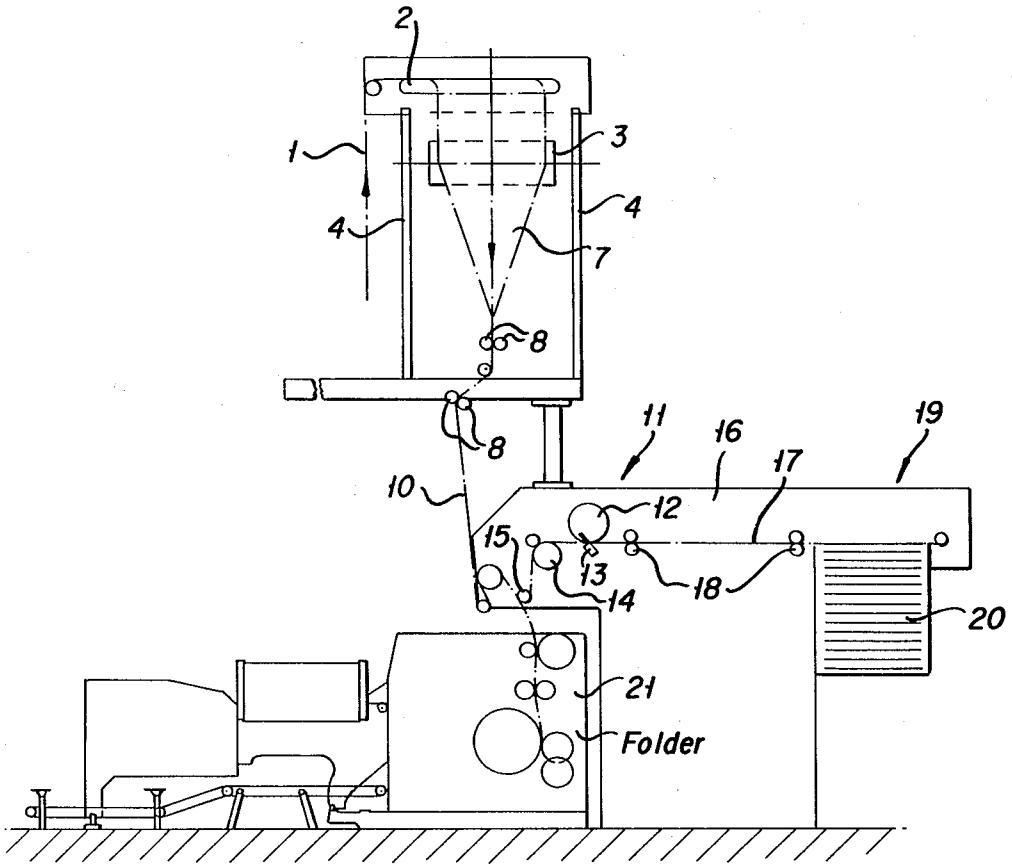

The construction and method of operation of the invention, however, together with additional objects and advantages thereof will be best understood from the following description of specific embodiments when read in connection with the accompanying drawings, in which:

FIG. 1 is a diagrammatic front elevational view of a device for feeding a paper web to a cross cutter, the device being constructed in accordance with the invention; and FIG. 2 is a side elevational view of FIG. 1 as seen from the left hand side thereof.

Referring now to the figures of the drawing, there is shown a paper web 1 which has been freshly printed by an otherwise non-illustrated printing machine, if necessary, guided in a conventional manner via angle or turner bars 2. The paper web 1 receives necessary web tension in the direction of movement of the paper web 1, after the turner bars 2, by means of a pair of draw rollers 3 which are mounted in side frames 4 and coupled with a drive 6 of the otherwise non-illustrated printing machine via a suitable drive connection represented by a dot-dash line 5.

Directly after i.e. downstream of, the pair of draw rollers 3, a conventional former 7 is provided by means of which the paper web 1 is guided and folded in longitudinal direction in the middle thereof. After or downstream from the former 7, draw rollers 8 are provided which further transport the then folded paper web 10.

Additional draw rollers 14 and register rollers 15 are located before or upstream of the cross cutter 11 which may be formed of a cutter roller 12 and a knife box or cutter bar 13. The cross cutter 11 with the draw and register rollers 14 and 15 is mounted in its own side frame 16. Sections 17 of the paper web 1 which are cut by the cross cutter 11 are fed via a conveyor 18 to a delivery unit 19 which is also termed an in-flat or broadsheet delivery unit. In the latter unit, the web sections 17 are deposited on a sheet stack 20 and can be fed in a conventional manner to another non-illustrated location for further processing.

When a folding apparatus 21 and a cross cutter 11 are arranged downstream of the printing machine, the invention provides an opportunity for using the former 7 both for the folding device 21 as well as for the cross cutter 11 with the broadsheet delivery unit 19. This arrangement obviates the necessity for an additional longitudinal folding device for the cross cutter 11 so that construction requirements and costs are considerably reduced.

With the particular construction of the invention, separate and independent operation of the cross cutter 11 and the folding device 21, and also subsequent or additional use of the one or the other of the two devices is possible. The production of covers for periodicals with higher grade paper quality veritably without smearing is possible without using the folding device heretofore located on a cross cutter and, instead, using a separate specialized folding device.

I claim:

1. Device for feeding a paper web to a cross cutter which is located downstream from a rotary printing machine in a travel direction of a paper web and which delivers cut sections of the paper web in flat disposition, comprising draw rollers and a former disposed downstream from the rotary printing machine for respectively tensioning and folding the paper web in longitudinal direction thereof, additional draw rollers and register rollers located downstream from the first-mentioned draw rollers and said former in the travel direction of the paper web for feeding the longitudinally folded paper web to a cross cutter, a folding apparatus disposed for folding the longitudinally folded paper web adjacent to the cross cutter downstream from the rotary printing machine in the travel direction of the paper web, said cross cutter and said folding apparatus being separate units independent of one another, and means located downstream from the first-mentioned draw rollers and said former and upstream from said cross cutter and said folding apparatus for selectively feeding the folded paper web to said cross cutter and said folding apparatus alternatively.

* * * * *